US007117952B2

(12) United States Patent
Bares et al.

(10) Patent No.: US 7,117,952 B2
(45) Date of Patent: Oct. 10, 2006

(54) AUTOMATED ATTACHMENT VIBRATION SYSTEM

(75) Inventors: Mark F. Bares, Oakes, ND (US); Charles H. Krause, Hankinson, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/800,001

(22) Filed: Mar. 12, 2004

(65) Prior Publication Data

US 2005/0211449 A1 Sep. 29, 2005

(51) Int. Cl.
*E02F 3/40* (2006.01)

(52) U.S. Cl. ..... 172/40; 37/238

(58) Field of Classification Search ..... 172/40, 172/2; 37/348, 403, 466
See application file for complete search history.

(56) References Cited

U.S. PATENT DOCUMENTS

| | | | | | |
|---|---|---|---|---|---|
| 3,061,117 | A | * | 10/1962 | Kruse | 414/21 |
| 3,145,488 | A | * | 8/1964 | French | 37/447 |
| 3,522,897 | A | | 8/1970 | Freedy | 214/764 |
| 3,739,505 | A | * | 6/1973 | Hicks et al. | 37/416 |
| 3,795,070 | A | | 3/1974 | Bronson | 37/117.5 |
| 4,032,015 | A | | 6/1977 | Hemphill | 214/767 |
| 4,037,743 | A | | 7/1977 | Pedersen | 214/140 |
| RE30,769 | E | * | 10/1981 | Cobb et al. | 299/67 |
| 4,324,525 | A | | 4/1982 | Lane et al. | 414/699 |
| 4,467,539 | A | | 8/1984 | Gurries | 37/118 |
| 4,592,696 | A | | 6/1986 | Carternock | 414/685 |
| 4,917,565 | A | | 4/1990 | Kourogi | 414/701 |
| 5,028,199 | A | | 7/1991 | Ikari et al. | 414/699 |
| 5,235,809 | A | | 8/1993 | Farrell | 60/445 |
| 5,287,699 | A | | 2/1994 | Takamura et al. | 60/327 |
| 5,308,220 | A | | 5/1994 | Schaeff | 414/699 |
| 5,356,259 | A | * | 10/1994 | Hanamoto et al. | 414/694 |
| 5,702,227 | A | | 12/1997 | Berg | 414/704 |
| 5,765,594 | A | | 6/1998 | Collins et al. | 137/625.48 |
| 5,860,231 | A | | 1/1999 | Lee et al. | 37/348 |
| 5,884,204 | A | * | 3/1999 | Orbach et al. | 701/50 |
| 5,946,832 | A | | 9/1999 | Koivuranta et al. | 37/444 |
| 6,226,902 | B1 | * | 5/2001 | Heyne | 37/348 |
| 6,751,896 | B1 | * | 6/2004 | Underwood | 37/403 |
| 6,757,992 | B1 | | 7/2004 | Berger et al. | 37/348 |

FOREIGN PATENT DOCUMENTS

| | | | |
|---|---|---|---|
| EP | 0471840 | A | 2/1992 |
| EP | 1361312 | A | 11/2003 |
| JP | 59 068446 | A | 4/1984 |
| JP | 11 107325 | A | 4/1999 |

* cited by examiner

*Primary Examiner*—Meredith C. Petravick
*Assistant Examiner*—Alexandra Pechhold
(74) *Attorney, Agent, or Firm*—Westman, Champlin & Kelly

(57) ABSTRACT

One embodiment of the present invention pertains to a system, including a mechanical arm, an attachment member, an actuator, a power system, an electronic control, and an operator interface. The attachment member is tiltably mounted on the mechanical arm about a pivot joint. The actuator is operably connected to the attachment member for powering the attachment member to tilt about the pivot joint. The power system is operably connected to the actuator. The electronic control is operatively connected to the power system, and comprises an automatic vibration mechanism for causing the attachment member to vibrate automatically in response to an activation signal. The operator interface is in operable communication with the electronic control. The system comprises a default state and an activation state for causing the activation signal.

23 Claims, 5 Drawing Sheets

AUTOMATED ATTACHMENT VIBRATION SYSTEM

BACKGROUND OF THE INVENTION

The present invention relates to vibration control systems, and more particularly but not by limitation, to automated vibration control systems for tiltably mounted attachments.

Power machines such as skid-steer and other types of loaders are well known. An operator of a loader operates an arm-mounted, tiltable attachment, such as a bucket, to perform useful functions such as digging, carrying, or compacting a subject material. The attachment is traditionally hydraulically powered, and may also be electrically powered. The operator controls the motions of the attachment, such as its tilt about a pivot joint by which it is connected to the arm, with an operator interface that typically includes joysticks and pedals.

One type of motion that often becomes desirable is a rapid vibration of an attached bucket. For example, when material is dumped or ejected from the bucket, the bucket is tilted to a forward-most position of which it is capable about the pivot joint by which it is mounted to the arm, some material often remains clinging to the bucket. A vibrating motion is then advantageous in disturbing the material from whence it clings and shaking out the clinging material. A vibration of the bucket can also provide advantage in digging the bucket effectively into a hard or cold material, or in compacting a material underneath a bucket or other attachment.

Many traditional controls for an attachment operate directly, such that a particular state of an operator interface such as a joystick or a pedal communicates a directly corresponding state in the hydraulic or electrical actuator controlling the attachment, such as a particular valve position or a particular orientation of the attachment. In machines such as these, causing a vibrating motion of the attachment typically requires the operator to attempt to vibrate the corresponding operator interface. Such direct, manual vibration of a joystick, pedal or other interface can become a nuisance for the operator, particularly over long periods of use.

Therefore, a need exists for a way to vibrate an attachment conveniently and ergonomically, to replace manual vibration of direct-action operator interfaces.

SUMMARY OF THE INVENTION

One embodiment of the present invention pertains to a system that includes a mechanical arm, an attachment member, an actuator, a power system, an electronic control, and an operator interface. The attachment member is tiltably mounted on the mechanical arm about a pivot joint. The actuator comprises a cylinder and a piston slidably engaged within the cylinder. The actuator is operably connected to the attachment member for powering the attachment member to tilt about the pivot joint. The power system is operably connected to the actuator. The electronic control is operatively connected to the power system, and comprises an automatic vibration mechanism for causing the attachment member to vibrate automatically in response to an activation signal. The operator interface is in operable communication with the electronic control. The system comprises a default state and an activation state for causing the activation signal.

Another embodiment of the present invention pertains to a power machine, including a frame, a plurality of ground engaging wheels, an engine, a mechanical arm, an attachment member, an actuator, a power system, an electronic control, and an operator interface. The plurality of ground engaging wheels supports the frame. The engine is operably connected to the wheels. The mechanical arm is operably coupled to the frame. The attachment member is tiltably mounted on the mechanical arm about a pivot joint. The actuator comprises a cylinder and a piston slidably engaged within the cylinder. The actuator is operably connected to the attachment member for powering the attachment member to tilt about the pivot joint. The power system is operably connected to the actuator. The electronic control is operatively connected to the power system, and comprises an automatic vibration mechanism for causing the attachment member to vibrate automatically in response to an activation signal. The operator interface is in operable communication with the electronic control. The system comprises a default state and an activation state for causing the activation signal.

Another embodiment of the present invention pertains to a method for causing a tiltably mounted attachment member to vibrate automatically. The method includes altering an operator interface from a default state to an activation state. The method also includes communicating an activation signal from the operator interface to an electronic control. The method further includes communicating an automated vibration command from the electronic control to a power system, operably connected to an actuator. The method also includes causing an attachment member, operably connected to the actuator and tiltably mounted on a mechanical arm about a pivot joint, to vibrate automatically in response to the automated vibration command.

Additional objects, features, and advantages of the present invention may be discerned through the corresponding description and figures, and inferred by those in the art from the general teaching of the present disclosure and in the course of practicing, manufacturing, using, and otherwise experiencing different embodiments, as defined by the appended claims.

DETAILED DESCRIPTION OF ILLUSTRATIVE EMBODIMENTS

Figure 1:
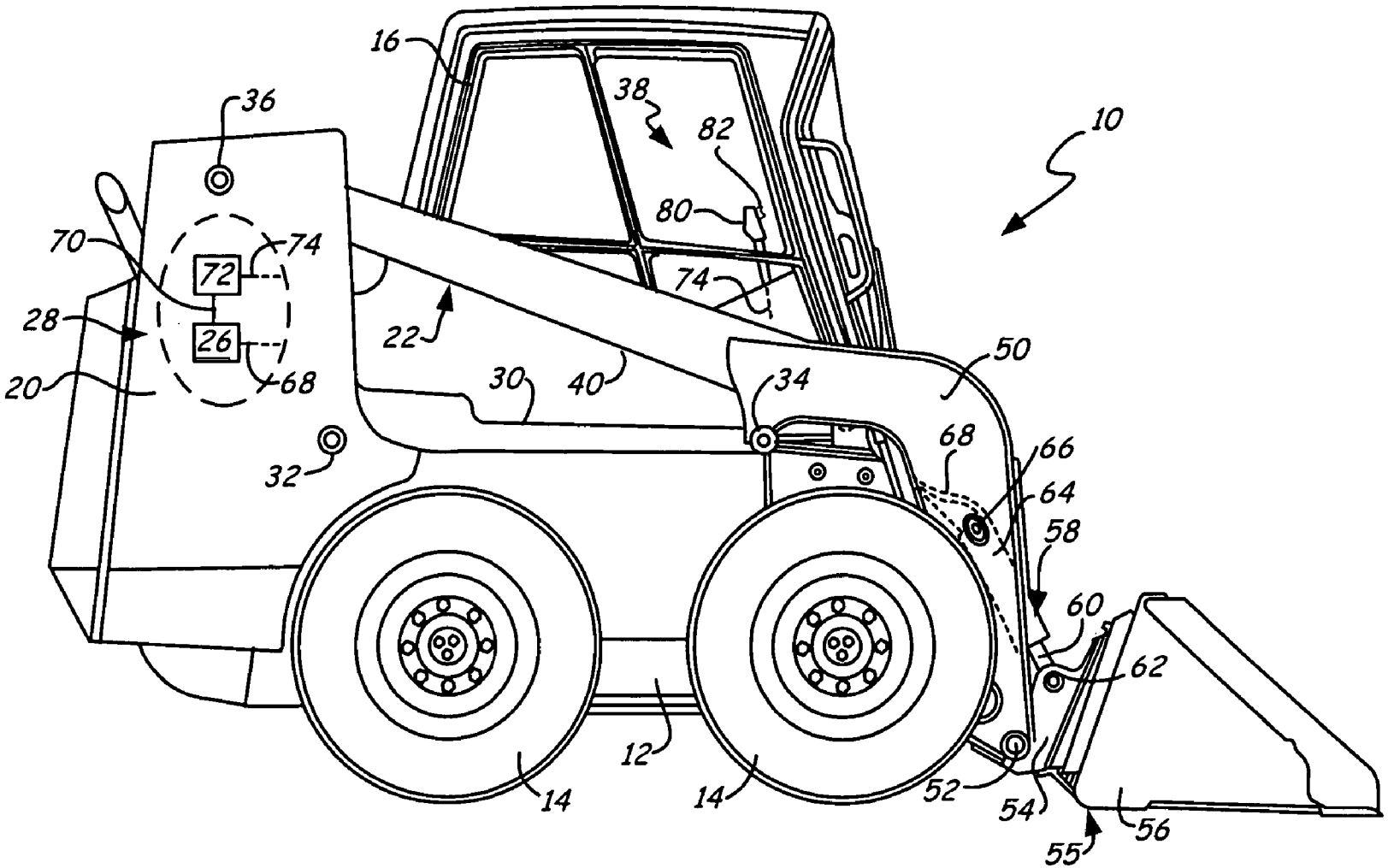
FIG. 1 is a side view diagram depicting an illustrative embodiment of a power machine of the present invention.

FIG. 1 is a side view diagram representation of a skid steer loader 10 including a system according to one illustrative embodiment of the present invention. Skid steer loader 10 has a frame 12, and drive wheels 14 for engaging the ground and propelling the loader across the ground, in this embodiment. Frame 12 supports an operator's cab 16, and an engine compartment 18 for housing a hydraulic power system (not shown in FIG. 1), which includes an engine (not shown in FIG. 1), a pump (not shown in FIG. 1), a hydraulic reservoir (not shown in FIG. 1), and. a valve block (not shown in FIG.

1). The frame 12 also includes frame plates 20 on which a lift arm assembly 22 is pivotally mounted on pivots 36. Attachment plate 54 and construction/industrial bucket 56 are mounted on lift arm assembly 22 about pivot joint 52, with powered tilting control of bucket 56 enabled by actuators 58. Attachment plate 54 and construction/industrial bucket 56 pivot together about pivot joint 52 and as a whole are labeled attachment member 55.

In this embodiment, skid steer loader 10 incorporates an automated attachment vibration system by which an activation signal, caused for example by a state of an input device or a sensor of the position, tilt, strain, or pressure associated with attachment member 55, in turn causes an automatic vibration mechanism to vibrate attachment member 55. This automatic vibration of the attachment member 55 may be advantageous for shaking out attached bucket 56, or for digging bucket 56 into a material, or for packing down a material with bucket 56, for example.

A variety of other structures embody the present invention. For instance, while the illustrative embodiment described above is directed to a riding power machine including operator's cab 16, in an alternative embodiment the frame supports an open console for a walk-behind machine. In a different embodiment, a remote control console is provided remotely from the power machine and is enabled to control the power machine from a remote location. This may take the form of a dedicated remote console, or a software application executable on a general-purpose computer, for example. As another illustrative example, while the illustrative embodiment described above is directed to a power machine supported by ground engaging wheels, in an alternative embodiment, the power machine is supported by ground engaging tracks. Other variations occur in further embodiments.

Lift arm assemblies 22 include lift arms 40 and depending forearms 50 fixed to the forward or distal ends of lift arms 40. Lift arm assemblies 22 are raised and lowered by pivoting lift arm assemblies 22 about pivots 36 with lift actuators 30, that have base end pivots 32 connected to frame plates 20, and rod ends connected at pivots 34 to the lift arms 40. Lift actuators 30 are controlled in a conventional manner by operator control of operatively connected valves of valve block 26 (depicted in cutaway), in cooperation with the engine (not shown in FIG. 1) and the pump (not shown in FIG. 1), and controlled via operator interface 38 and electronic control 72.

Upon extending and retracting the lift actuators 30 under the control of valve block 26, the lift arms 40 are raised and lowered, within a range of lift. Depending forearms 50 are connected to each other with a mutual pivot joint 52. Pivot joint 52 also has attachment plate 54 tiltably mounted on it, such that attachment plate 54 has significant freedom of rotational tilt about pivot joint 52.

Attachment plate 54 is configured for any of a variety of additional attachments to be connected or mounted to it temporarily or permanently. As depicted in FIG. 1, construction/industrial bucket 56 is mounted on attachment plate 54 as illustrative of a useful additional attachment for mounting on attachment plate 54. The collective individual attachments, attachment plate 54 and bucket 56, are comprised in general attachment member 55. In alternative embodiments, the attachment member may comprise only an attachment plate, upon which an additional attachment such as a bucket may optionally be mounted on the attachment member; or only a unitary bucket connectable to the pivot joint and attachment actuators; or some other structure tiltably mounted on the mechanical arm about the pivot joint.

Attachment member 55 has a range of lift above a projected ground surface due to the raising and lowering of lift arms 40 upon which attachment member 55 is mounted. The projected ground surface is a projection roughly delimiting the minimum lift, or lowest lift, the attachment member 55 may have. In embodiments such as skid steer loader 10, which is one exemplary embodiment of a system of the present invention, the projected ground surface may be projected as in plane with the ground upon which the wheels 14 are resting.

This is only a rough delimitation of the minimum lift of attachment member 55 in some embodiments. For instance, in some embodiments the lift arms 40 are able to exert a lowering force on attachment member 55 once it is already on the ground, thereby acting instead to pivot skid steer loader 10 up about its back wheels and raise the forward wheels above the ground surface, in which case the minimum lift bound on the range of lift is below the plane of the bottoms of the wheels 14. The minimum lift, therefore, may be substantially lower than a projection coplanar with the bottoms of the wheels 14, in some embodiments.

The maximum lift, forming the upper bound on the range of lift of the attachment member 55, corresponds with the maximum extension of lift actuators 30, and/or with the greatest height above the projected ground surface the loader 1*b* is able to raise the attachment member 55, in various illustrative embodiments.

Attachment actuators 58 are also connected to attachment plate 54 in the embodiment of FIG. 1, such that they can power bucket 56 in tilting back and forth about pivot joint 52, with attachment plate 54 and bucket 56 comprised together in generalized attachment member 55 in this embodiment. Each individual attachment actuator 58 includes a piston 60 rotatably connected with attachment plate 54 about pivot connection 62, and a cylinder 64 rotatably connected with a depending forearm 50 of an individual lift arm assembly 22, about pivot connection 66. Each piston 60 is slidably received within the corresponding cylinder 64. Each attachment actuator 58 has a hydraulic lines 68 leading to it from valve block 26, through which hydraulic power system 28 supplies attachment actuators 58 with pressurized hydraulic flow.

A range of tilt is thereby defined for the attachment member 55, with an extreme rearward orientation of attachment member 55 corresponding to a complete contraction of attachment actuators 58, and an extreme forward orientation of attachment member 55 corresponding to a complete extension of attachment actuators 58. The range of tilt of attachment member 55 is discussed further below, particularly in reference to FIGS. 4 and 5.

Valve block 26 of hydraulic power system 28 (depicted in cutaway) includes electronic valve actuators (not shown) with electronic connections 70 with electronic control box 72. Control box 72 contains an automatic vibration mechanism, such as a processor running an algorithm, a signal generator circuit, or some other known means, for automatically controlling hydraulic power system 28 to provide hydraulic flow and pressure through hydraulic lines 68 to attachment actuator 58, such that attachment plate 54 is vibrated. For example, by rapidly alternating oil flow and/or pressure between valves controlling the expansion and contraction of attachment actuators 58, attachment member 55 is vibrated.

Control box 72 is also connected by electrical connection 74 with operator interface 38. Operator interface 38 includes joystick 80 upon which push button 82 is disposed. Push button 82 is the operator control for the automatic attachment vibration. Electrical connection 74 includes a connection with a switch internal to push button 82. In this embodiment, push button 82 has a default state in which it projects from the handle of joystick 82, and its associated switch is open. Push button 82 occupies the default state when not acted upon. Push button 82 also has an activation state, in which it is depressed into the handle of joystick 82, and its associated switch is closed. Push button 82 may be placed into the activation state by the operator of the loader.

When push button 82 is in its depressed, activation state, and its associated switch is therefore closed, a signal is sent to the electronic control box 72 to activate the automatic vibration mechanism, resulting in the vibration of attachment plate 54 and bucket 56 mounted thereon, in this embodiment. This is one example of many mechanisms for triggering the activation state which occur in various embodiments, other examples of which are described below and in the claims.

In one embodiment, the automatic vibration mechanism is signaled to stand down when the push button is released from its depressed position back to its default position. Variations occur in alternative embodiments, such as the automatic vibration mechanism continuing to cause the automatic vibration of the attachment after the push button has been released from its depressed position, until the push button is depressed a second time; or until a second, cease-vibrate push button is depressed, for instance.

Figure 2:
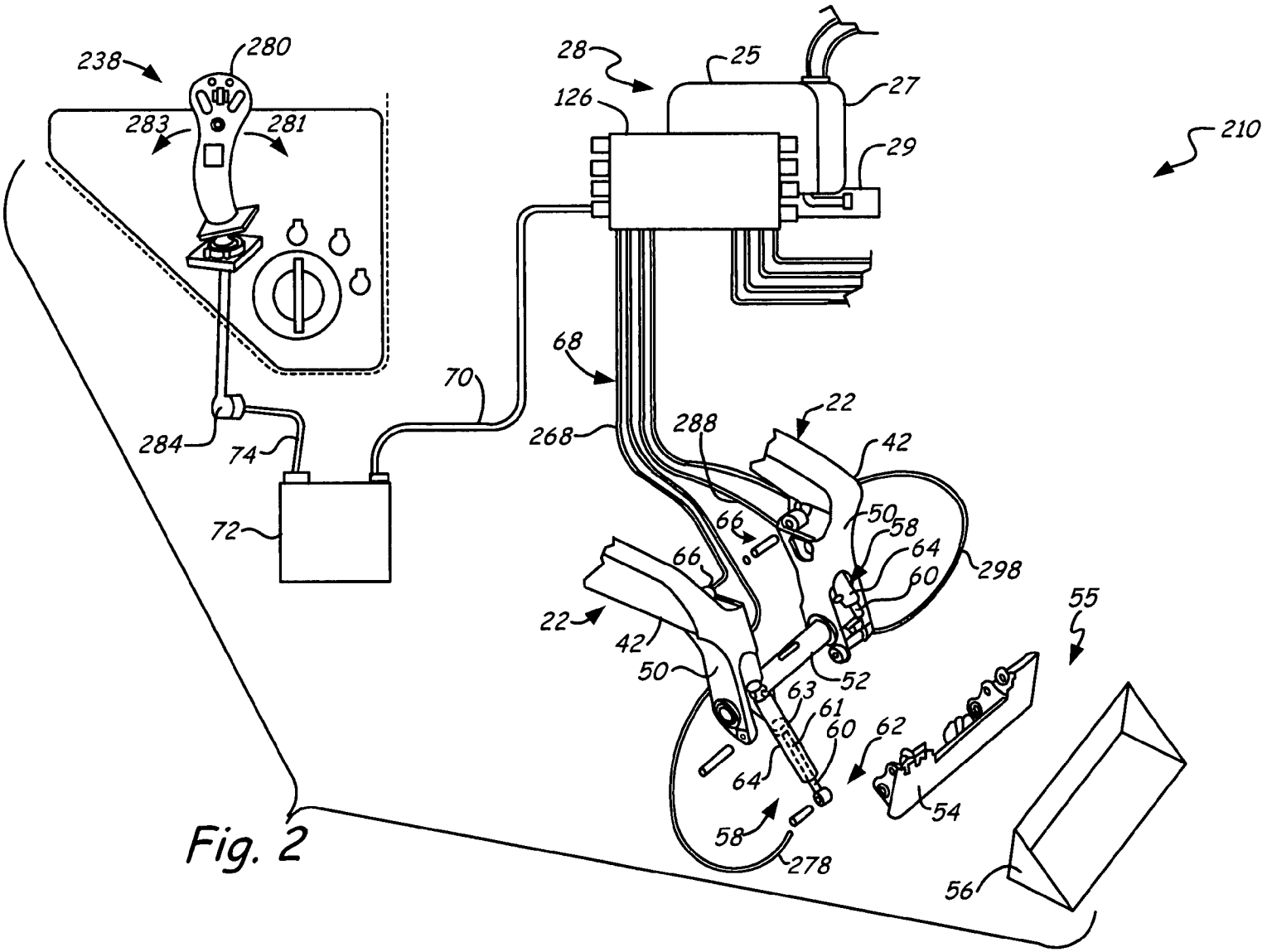
FIG. 2 is a fragmented, perspective diagram depicting an illustrative embodiment of a system of the present invention.

FIG. 2 is a fragmented, cutaway depiction of another illustrative embodiment. System 210 includes mechanical arms 22, attachment member 55, actuators 58, hydraulic power system 28, electronic control 72, and operator interface 238, configured together similarly to the embodiment of FIG. 1.

Each mechanical arm 22 includes a depending forearm 50, in this illustrative embodiment. Attachment member 55 includes attachment plate 54 and attached bucket 56. Attachment plate 54 is configured to mount on the two depending forearms 50 of the two mechanical arms 22 about pivot joint 52, such that attachment member 55 has significant freedom of rotational tilt about pivot joint 52, in this illustrative embodiment.

Each mechanical arm 22 is configured in its depending forearm 50 for attachment of respective actuator 58 about pivot joint 66, in this illustrative embodiment. Each of the two actuators 58 includes a cylinder 64 and a piston 60 slidably engaged within the cylinder 64. Each cylinder 64 is configured to attach to its respective depending forearm 50 about respective pivot joint 66, while each piston is configured to connect to attachment plate 54 about respective pivot joint 62. The attaching ends of actuators 58 therefore have significant freedom of rotation about their respective pivot joints 66, 62, in this illustrative embodiment.

Each piston 60 includes a piston shaft 61 and a piston face 63, in this illustrative embodiment. The interior of each cylinder 64 is divided by piston face 63 into separate regions, between which hydraulic oil is prevented from flowing. Hydraulic lines 68 include separate hydraulic lines 268, 278, 288, 298 to supply actuators 58, in this embodiment. Each actuator 58 therefore is enabled to receive differential hydraulic pressures to drive expansion or contraction of the respective actuator 58, and thereby to power attachment member 55 to tilt about the attachment pivot joint 52, in this illustrative embodiment.

Hydraulic lines 68 form an operative hydraulic connection to actuators 58 from hydraulic power system 28, which is one type of power system for a hydraulic embodiment of system 210. Hydraulic power system 28 includes electrically controlled valve block 26, pump 25, diesel engine 27, and oil reservoir 29, in a typical operating arrangement as is readily familiar in hydraulic machine design. Hydraulic power system 28 provides hydraulic power to attachment actuators 58, in this illustrative embodiment.

Hydraulic power system 28 is electrically controlled, via electrical connection 70 among others, leading from electronic control 72. Electronic control box 72 contains an automatic vibration mechanism, such as a processor running an algorithm, a signal generator circuit, or another known means, for automatically controlling hydraulic power system 28 to provide hydraulic flow and pressure through hydraulic lines 68 to attachment actuators 58 such that attachment member 55 is vibrated.

When a simple input signal corresponding to an activation state is received by electronic control 72 from operator interface 238 via electrical connection 74, the automatic vibration mechanism is triggered, and the appropriate control signal is sent over electrical connection 70. This causes hydraulic power system 28 to alternate rapidly the pressure differential on either side of each piston face 63 within each respective actuator 58, and thereby to cause attachment member 55 to vibrate.

Electrical connection 74 is operatively connected to sensor 284, itself connected to joystick 280 included in operator interface 238, in this particular embodiment. Sensor 284 translates the orientation state of joystick 280 into an electrical signal transmitted along electrical connection 74 to electronic control 72, in this illustrative embodiment. While the activation state may therefore comprise a state of a joystick 280, a push button 82, or other aspect of the operator interface 238, the activation state may otherwise or also comprise a state of the attachment member 55, such as its lift or its tilt, or a state of the attachment actuators 58, such as their load, as measured for example by their hydraulic pressure or their mechanical strain, for example. These and other states, singly or in concert, can be comprised in the activation state in various embodiments.

Joystick 280 has a default state, in which it occupies a centered orientation within its range of motion. Joystick 280 controls the expansion and contraction of actuators 58, and thereby controls the tilt of attachment member 55 about pivot joint 52. In this embodiment, when joystick 280 is oriented toward the right side 281 of its range of motion, the actuators 58 are caused to expand, and attachment member 55 is therefore caused to tilt downward. On the other hand, when joystick 280 is oriented toward the left side 283 of its range of motion, the actuators 58 are caused to contract, and attachment member 55 is therefore caused to tilt upward.

In this embodiment, the right side 281 of the range of joystick 280 is a predetermined orientation for tilting attachment member 55 forward, while the left side 283 of the range of joystick 280 is a predetermined orientation for tilting attachment member 55 rearward. This arrangement of joystick controls for a loader attachment is a common functional standard for the right-hand joystick of a loader, including for example in both the International Organization for Standardization (ISO) standard and the so-called "H" standard, both of which are well known in the art. In alternative embodiments, a different predetermined joystick orientation causes the attachment to tilt forward.

The operator interface 238 may be comprised in a cab for one embodiment directed to a riding machine; or may be comprised in an open console for an alternative embodiment directed to a walk-behind machine; or may be directed to a remote control in yet another embodiment, in which electrical connection 74 is replaced by a wireless electromagnetic connection, for instance.

Attachment member 55 has a range of motion about pivot joint 52 which can be described with one variable, an angle of tilt, bounded by two extrema, an extreme forward orientation and an extreme rearward orientation. The predetermined orientation of joystick 280 for tilting attachment member 55 forward can be considered the forward-tilt orientation of joystick 280. When joystick 280 is put in its forward-tilt orientation, attachment member 55 tilts from its starting orientation somewhere in its range of motion, and tilts therefrom toward its extreme forward orientation, in this embodiment.

In one illustrative embodiment, if joystick 280 is kept in the forward-tilt orientation after attachment member 55 has tilted all the way to its extreme forward orientation, then attachment member 55 is prepared to enter an activation state. In another embodiment, joystick 280 is then prepared to enter an activation state. The activation state may originate with the operator interface 238 or the attachment member 55, the attachment actuators 58, or some other component, in different embodiments. In one embodiment, the activation state requires joystick 280, attachment member 55, or the relevant other component to remain in a particular orientation or position for a predetermined amount of time. For example, in one illustrative embodiment, only if joystick 280 remains in the forward-tilt orientation while attachment member 55 is also tilted to its extreme forward orientation, is the activation state caused and the activation signal sent.

In this embodiment, the activation state of the joystick 280 includes the joystick 280 being oriented in its forward-tilt orientation for a predetermined amount of time. That amount of time may include the time it takes for attachment member 55 to tilt all the way forward to its extreme forward orientation, in which case the amount of time is predetermined at least in part by the orientation of attachment member 55 within its range of motion. The joystick 280 may also have to be kept in its forward-tilt orientation for a pre-selected amount of time after attachment member 55 has reached its extreme forward orientation, in which case the predetermined amount of time is determined at least in part by that pre-selected amount of time, in this embodiment.

The activation state of joystick 280 activates the automatic vibration mechanism included in electronic control 72, for the automatic vibration of attachment member 55. In this embodiment, this activation state occurs when joystick 280 is kept positioned toward the right side 281 of its range of motion for a predetermined amount of time beyond that needed to extend actuators 58 to their full extension. In another embodiment, the activation state is achieved when actuators 58 achieve their full extension, without any additional passage of time. The extreme forward orientation of the attachment occurs when actuators 58 are fully extended, that is when pistons 60 are fully extended from cylinders 64. When attachment member 55 comprises bucket 56, this also corresponds to a dumping-out position of bucket 56.

This automated function may be particularly advantageous, for example, in aiding the operator to shake out bucket 56. Because the automatic vibration mechanism causes bucket 56 to vibrate automatically in response to a simple input signal caused by the operator interface 238 being set to its activation state, the operator is spared the nuisance of regularly trying to vibrate bucket 56 directly by trying manually to vibrate a joystick.

A variety of operator interfaces incorporating a variety of simple activation states may be included in the condition parameters for causing the automatic vibration mechanism. Examples of the variety of operator interfaces and activation states thereof are illustrated with the push button 82 of FIG. 1, with its activation state of being depressed; and with the joystick 280 of FIG. 2, with its activation state of being oriented toward the right side 281 of its range of motion. In some embodiments, these position or orientation states of operator interface components may be required to be occupied for a predetermined amount of time beyond that needed to extend actuators 58 to their full extension, before causing the activation state. That predetermined amount of time might illustratively be 20 milliseconds, 50 milliseconds, 500 milliseconds, or some other period of time that could be advantageous for the operator.

In an alternative embodiment, the activation state of the joystick 280 may be combined with another requirement, such as for the lift position control of attachment member 55. The lift position of attachment member 55 is controlled by lift actuators 30 operating to raise and lower lift arm assemblies 22. Thereby, attachment member 55 may be put in a lift position anywhere from low to the ground to high in the air, or otherwise from a minimum lift position to a maximum lift position, in this embodiment.

In this embodiment, the activation state requires that attachment member 55 occupy a certain minimum height in the air or higher. Particularly, the operator interface 238 includes a lift position control, and the lift position control must be within a predetermined range corresponding to the state-allowed range of the lift position of attachment member 55, for operator interface 238 to be in the activation state.

For example, the minimum height may be selected as ten centimeters or one meter, for example above a projected nominal ground level, that is, about where the ground would be if it were coplanar with the bottoms of wheels 14, for example. Other heights greater than or less than within this range can also be used in other embodiments. This may be an advantageous feature for the purpose of ensuring that the automatic vibration mechanism is used for shaking out the bucket 56 only when it is above a certain selected height, for instance. Other variations on this state requirement can also occur in various embodiments, such as requiring the lift position of attachment member 55 to be under a certain maximum value, or within a certain range with both minimum and a maximum values.

The lift position of attachment member 55 is also controlled by the operator via operator interface 238, such as by the forward and rearward orientations of joystick 280, as one example. In this embodiment, the control of the lift position serves as a conditional parameter for determining whether the activation state of joystick 280 is turned on, that is, whether joystick 280 is in its activation state. The requirements for the activation state are not met if the lift position of attachment member 55 is not within the predetermined range, such as at least one meter above the projected ground level, for example. So in this embodiment, the activation state includes the lift position being within the predetermined range. That is, the lift position being in the predetermined range is a necessary but not sufficient condition for the activation state, in this illustrative embodiment.

The automated vibration function may be particularly advantageous, as another example, in aiding the operator to use bucket 56 for digging, particularly for digging into a material that is particularly hard, cohesive, or frozen, for example. Some embodiments include a particular activation state intended for digging, in which the activation state includes the attachment member 55 being in a position and an orientation that are consistent with digging. In some embodiments, this may include attachment member 55 having a lift position that is relatively low toward or coincident with the projected ground surface, and an intermediate tilt orientation with bucket 56, for instance, relatively parallel or at a slight forward angle to the projected ground surface.

However, since digging may often be done of a pile or mound of material that rises well above the projected ground surface of skid steer loader 10, a very broad segment of the range of lift may be included in the conditional parameters included for causing the activation state, perhaps extending up through the maximum lift position, in some embodiments, depending on the particular performance requirements for which the embodiment is intended.

This automated vibration function may also be particularly advantageous, as another example, in aiding the operator to use bucket 56 for packing or compressing materials down. Corresponding embodiments may include a particular activation state intended for packing, in which the activation state includes the attachment member 55 being in a position and an orientation that are consistent with packing. For instance, one embodiment may include a segment of the lift position in the low part of the range of lift, including the minimum lift position, while excluding the upper portion of the range of lift, as a conditional parameter for causing the activation state. This embodiment may also include a segment of the range of tilt orientation toward a rearward orientation and perhaps including the extreme rearward orientation, while excluding a segment of the range of tilt orientation toward the forward part of the range of tilt.

However, other embodiments may include intended use for packing down materials at a significant height above the projected ground surface, and include a very large segment of the lift position, as consistent with packing, in the conditional parameters for causing the activation state. The segment of the tilt orientation for causing the activation state consistent with packing is also variable among different embodiments, particularly in view of the particular form of the attachment member or additional attachment intended to be used for the application. Therefore, a variety of options for activation state may occur in various embodiments.

As yet another example, some embodiments include a means of sensing the load on the attachment, and include in the conditional parameters for the activation state for the sensor to detect that the attachment member undergoes a minimum load, that is, a load that is at least equal to a comparison value of load. The attachment member may undergo the minimum load if it encounters a threshold of resistance from a material it is digging or packing, for example. The means for sensing the load on the attachment member may be, for instance, a mechanical strain sensor, or a hydraulic pressure sensor in a hydraulically powered embodiment, or some other means in other embodiments.

In various embodiments, therefore, the attachment plate has a range of tilt bounded by an extreme forward orientation and an extreme rearward orientation, and/or a range of lift bounded by a minimum lift and a maximum lift; wherein the activation state comprises the attachment plate being oriented within a predetermined segment of the range of tilt, and/or positioned within a predetermined segment of the range of lift. In some embodiments, these conditions of lift and tilt state must persist for a predetermined length of time before causing the activation state. In various embodiments related to shake-out, the predetermined segment of the range of tilt occupies a forward segment of the total range of tilt so that it includes the extreme forward tilt orientation, and/or the predetermined segment of the range of lift occupies an upper segment of the total range of lift so that it includes the maximum lift position, such as might be advantageous for a bucket shake-out function embodiment, as one illustrative embodiment of the advantageous function of the present invention.

In some of these embodiments, the tilt orientation and lift position of the attachment plate are linked to corresponding states of the electronic control, so that the tilt orientation and lift position occupying the activation state correspond to the electronic control being in the activation state. The sensor or signal source for indicating that an activation state conditional parameter has been met may be associated with the attachment member 55, with attachment actuators 58, with the operator interface 238, or with some other component, in various embodiments. It may therefore be appropriate to consider any of these various components as having a default state, in which the activation signal is not caused, and an activation state which serves to cause the activation signal, as is appropriate for a specific embodiment.

In another alternative embodiment, the activation state occurs when the joystick is jiggled, or in other words is manually vibrated by the operator, though with the automated vibration able to continue after the jiggling that triggered it has ceased. If an operator tries to begin jiggling the joystick to cause the attachment to vibrate, as an operator might be accustomed to doing, the input to electronic control 72 generated thereby will be interpreted by the automatic vibration mechanism as an activation signal, to trigger the automatic vibration mechanism and cause the automatic vibration of bucket 56. The operator may then stop jiggling the joystick and the automatic vibration mechanism will continue to vibrate bucket 56 until the time for its vibration is finished.

In some embodiments, the activation state corresponding to an attempted manual joystick vibration exists as an additional, backup activation state, included along with a lower-effort activation state such as those described above, such as pushing a button or holding the joystick in its right-side position after the corresponding actuators 58 have been fully extended.

The cessation of the automatic vibration signal can also take different forms. In one embodiment, the automatic vibration mechanism is signaled to stand down when the user interface 238 is subsequently altered out of the activation state, for instance by orienting joystick 280 away from rightward limit 281 to a default or leftward position. This causes attachment member 55 to respond by stopping vibrating. In alternative embodiments, the automatic attachment vibration is set to stand down spontaneously after a predetermined amount of vibration time, or to respond to some other stand down signal.

Another illustrative example of an operator interface is a pedal, controlling the extension of the bucket tilt actuators, wherein the pedal is in its default state when it is not being depressed, and the activation state of the pedal includes being depressed, for example by the operator's foot. This may comprise the activation state alone, or in combination with an interval of time after the bucket tilt actuators are fully extended.

Yet another illustrative example of an operator interface is a toggle switch, with a neutral position corresponding to a default state, and a toggled position corresponding to an activation state. Other types of operator interfaces with a default state and activation state that triggers the bucket automatic vibration mechanism also occur in additional, alternate embodiments.

Figure 3:
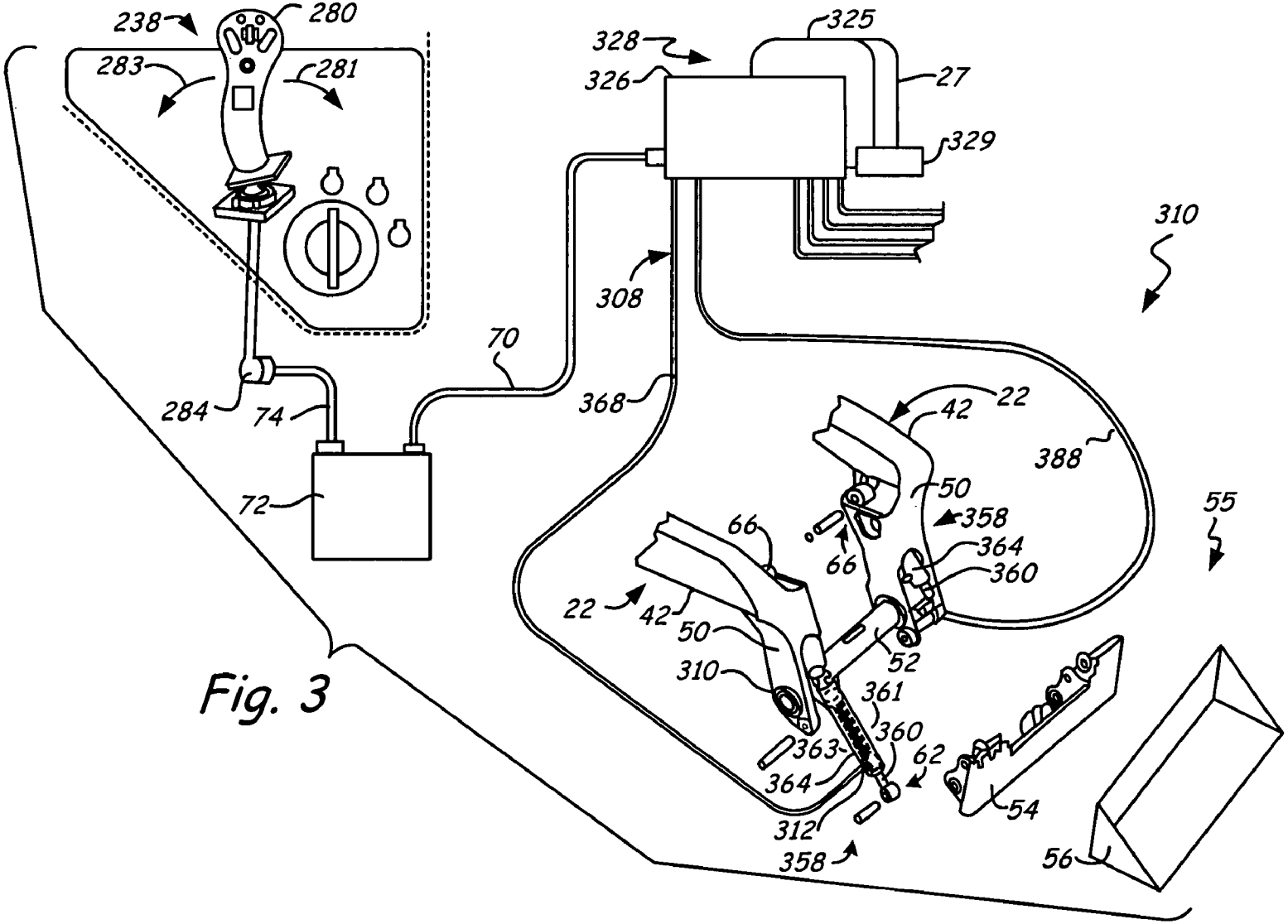
FIG. 3 is a fragmented, perspective diagram depicting another illustrative embodiment of a system of the present invention.

FIG. 3 is a fragmented, cutaway depiction of another illustrative embodiment. System 310 includes mechanical arms 22, attachment member 55, actuators 58, electrical power system 328, electronic control 72, and operator interface 238, configured together similarly in some ways to the embodiment of FIGS. 1 and 2.

Each mechanical arm 22 includes an inner lift arm tube 42 and a depending forearm 50. Attachment member 55 includes attachment plate 54 and attached bucket 56. Attachment plate 54 is configured to mount on the two depending forearms 50 of the two mechanical arms 22 about pivot joint 52, such that attachment member 55 has significant freedom of rotational tilt about pivot joint 52.

Each mechanical arm 22 is configured in its depending forearm 50 for attachment of respective actuator 58 about pivot joint 66. Each of the two actuators 58 includes a cylinder 364 and a piston 360 slidably engaged within the cylinder 364. Each cylinder 364 is configured to attach to its respective depending forearm 50 about respective pivot joint 66, while each piston is configured to connect to attachment plate 54 about respective pivot joint 62. The attaching ends of actuators 58 therefore have significant freedom of rotation about their respective pivot joints 66, 62.

Each piston 360 includes a piston shaft 361 and a rack face 363. Rack face 363 is mated to an electric motor pinion 312, housed inside each cylinder 364. Electric motor pinions 312 are electrically powered via signal lines 368, 388 respectively, from signal generator 326. Each actuator 358 is thereby enabled to extend or retract due to the engagement of the powered pinion 312 of the cylinder 364 with the rack face 363 of the piston 360, and thereby to power attachment member 55 to tilt about the attachment pivot joint 52. Electric motor pinion 312 is disposed on the interior of cylinder 364 on the side closest to pivot joint 62, allowing it to remain engaged with rack face 363 of piston 360 while maximizing the range of extension of piston 360.

Electrical lines 308 form an operative connection to actuators 58 from electric power system 328, which is another, electrical type of power system for an embodiment of system 310. Electric power system 328 includes electronically controlled signal generator 326, battery 325, diesel engine 27, and alternator 329, in a typical operating arrangement as is readily familiar in the design of electrical systems. Electrical power system 328 provides electrical power to attachment actuators 358.

Electric power system 328 is electronically controlled, via electrical connection 70 among others, leading from electronic control 72. Electronic control box 72 contains an automatic vibration mechanism, such as a processor running an algorithm, a signal generator circuit, or another known means, for automatically controlling electric power system 328 to provide electric voltage through signal lines 368, 388 to electric motor pinions 312 of attachment actuators 58 such that electric motor pinions 312 rapidly oscillate rack faces 363 of pistons 360, and attachment member 55 is vibrated.

When a simple input signal corresponding to an activation state is received by electronic control 72 from operator interface 238 via electrical connection 74, the automatic vibration mechanism is triggered, and the appropriate control signal is sent over electrical connection 70. This causes electric power system 328 to alternate rapidly the spin direction of electric motor pinion 312 engaged with rack face 363 of piston 360 within each respective actuator 358, and thereby to cause attachment member 55 to vibrate. Alternative embodiments use a variety of other well-understood mechanisms for causing the attachment to vibrate automatically by alternating a drive direction of an electric motor associated with the actuator.

Electrical connection 74 is operatively connected to sensor 284, itself connected to joystick 280 included in operator interface 238, in this particular embodiment. Sensor 284 translates the position state of joystick 280 into an electrical signal transmitted along electrical connection 74 to electronic control 72. Operator interface 238 thereby operates similarly to that of FIG. 2, either using joystick 280 as depicted, or as in alternative embodiments such as those described above.

Figure 4:
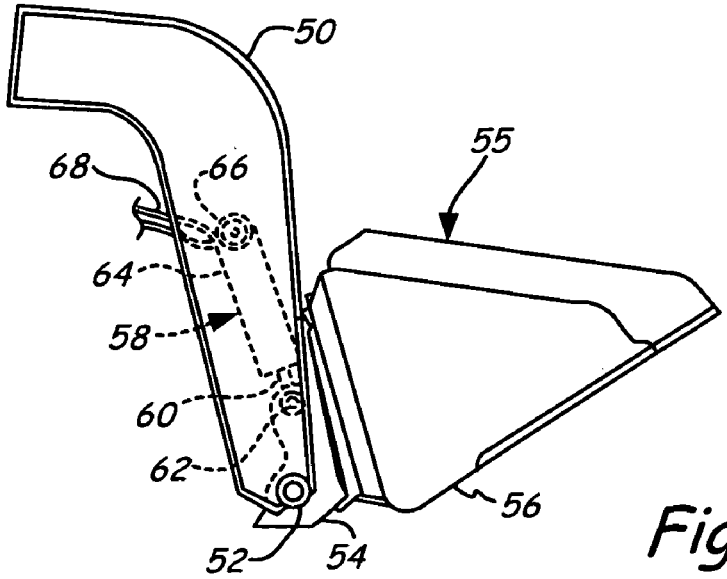
FIG. 4 is a side view diagram depicting part of a lift arm assembly with attachment, according to one embodiment.

FIG. 4 is a side view of a forward portion of lift arm assembly 22, including depending forearms 50 and attachment member 55, depicted with attachment member 55 occupying its extreme rearward orientation.

Attachment actuators 58 are connected to attachment plate 54 of attachment member 55, such that actuators 58 can power bucket 56 in tilting back and forth about pivot joint 52. Each individual attachment actuator 58 includes a piston 60 rotatably connected with attachment plate 54 about pivot connection 62, and a cylinder 64 rotatably connected with a depending forearm 50 of an individual lift arm assembly 22, about pivot connection 66. Each piston 60 is slidably received within the corresponding cylinder 64. Each attachment actuator 58 has a hydraulic line 68 leading to it from valve block 26 (not depicted in FIG. 4), through which power system 28 supplies the attachment actuator 58 with pressurized hydraulic flow.

Attachment member 55 is placed in its extreme rearward orientation by retracting pistons 60 to their most retracted state within cylinders 64 of actuators 58.

Figure 5:
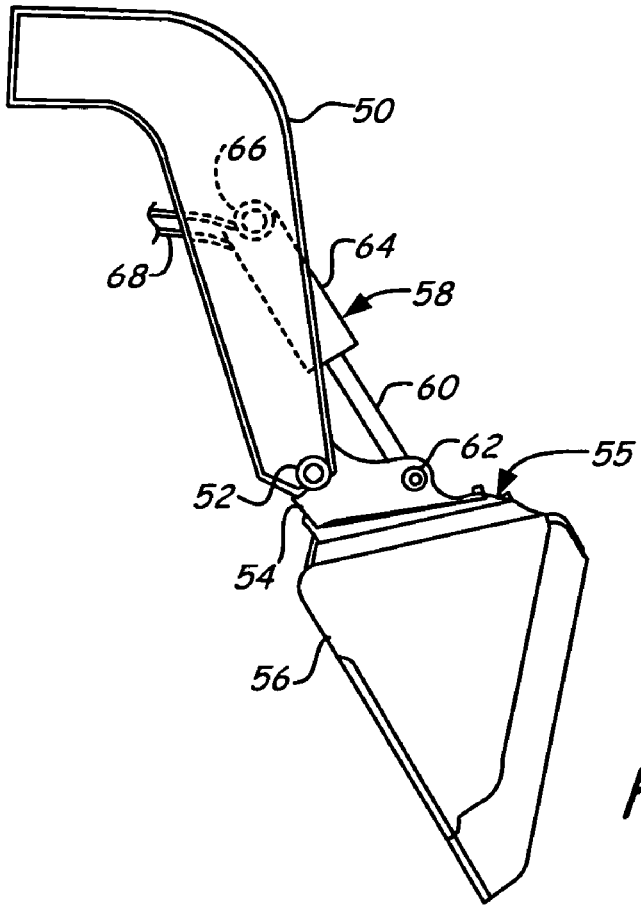
FIG. 5 is another side view diagram depicting part of a lift arm assembly with attachment, according to one embodiment.

FIG. 5 is another side view of a forward portion of lift arm assembly 22, including depending forearms 50 and attachment member 55, now depicted with attachment member 55 occupying its extreme forward orientation.

Attachment actuators 58 remain connected to attachment plate 54 of attachment member 55, as described above. Each individual attachment actuator 58 includes a piston 60 rotatably connected with attachment plate 54 about pivot connection 62, and a cylinder 64 rotatably connected with a depending forearm 50 of a lift arm assembly 22, about pivot connection 66. Each piston 60 is slidably received within the corresponding cylinder 64. Each attachment actuator 58 has a hydraulic lines 68 leading to it from valve block 26 (not depicted in FIG. 5), as described above.

Attachment member 55 is placed in its extreme forward orientation by extending pistons 60 to their most extended state out from cylinders 64 of actuators 58. It is this forward-most orientation of attachment member 55 that serves as a component condition for the activation state to be achieved, and the automatic vibration mechanism to activate. Attachment member 55 is thereby vibrated while in its forward-most orientation, and thereby bucket 56 is shaken out, in this illustrative embodiment.

Other effects and purposes can also be achieved in other embodiments, including other attachments and orientations. For instance, in an alternative embodiment, the automatic vibration of attachment member 55 may be applied to a digging implement attachment, thereby increasing its performance in digging into a stubborn target material. As another example, the automatic vibration of attachment member 55 may be applied to a substantially flat level attachment, the purpose of which includes compacting a ground surface. A rearward tilt or a low lift position may be required conditions for the activation state, in this alternative embodiment, as another example.

Figure 6:
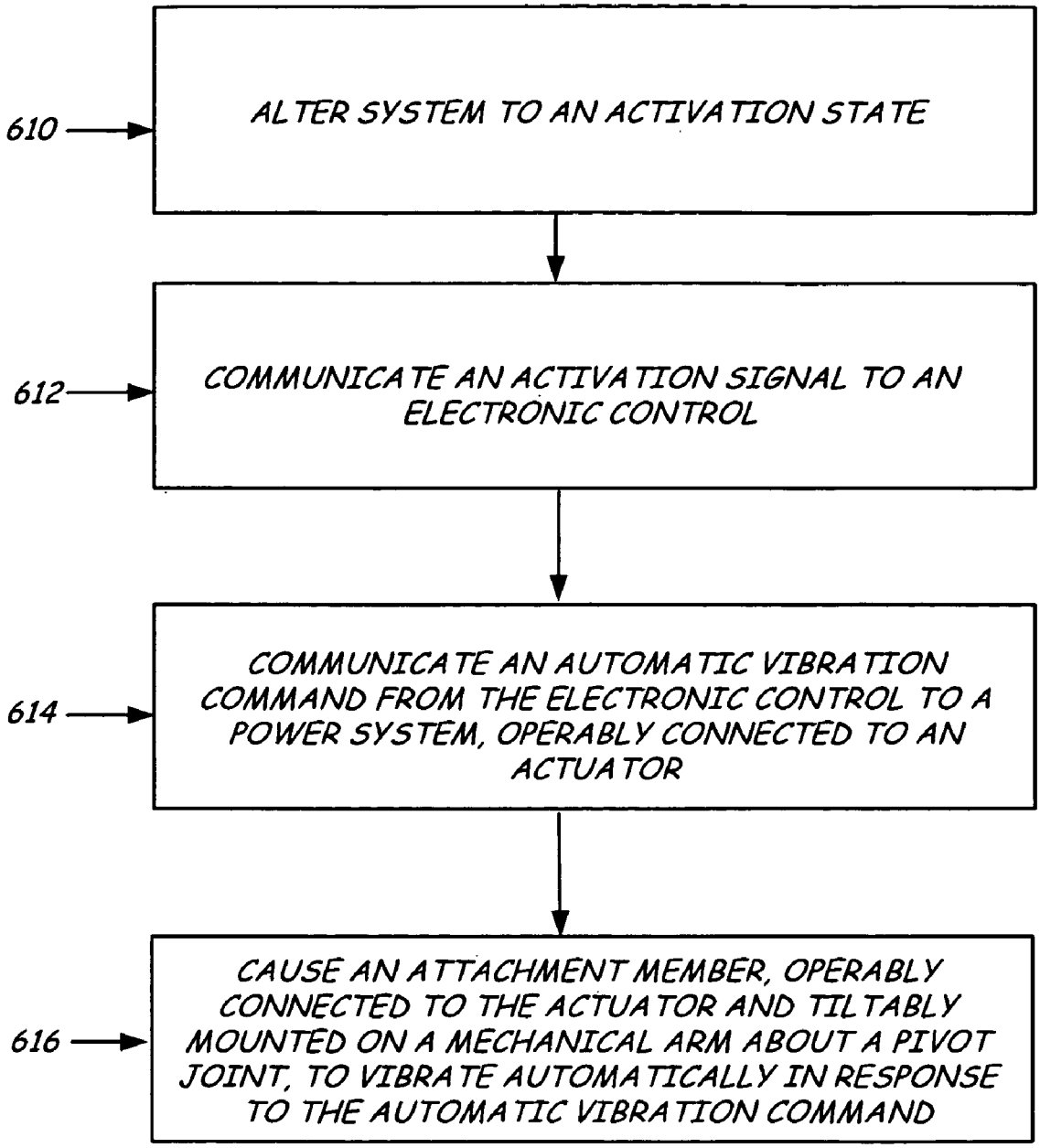
FIG. 6 is a flow chart depicting an illustrative embodiment of a method of the present invention.

FIG. 6 is a flow chart depicting an illustrative embodiment of a method of the present invention. Other embodiments of methods of the present invention include additional steps, a different order of steps, and other variations on the particular illustrative method depicted here.

Step 610 includes altering a system from a default state to an activation state. This is a generalized way to describe, for instance, pushing a button. For example, when the relevant operator interface for triggering the activation signal is a push button such as push button 82 of FIG. 1, altering the push button from its default state to its activation state involves pushing the button.

Similarly, following the embodiment of FIGS. 2 and 3, the relevant operator interface is joystick 280, and altering joystick 280 from its default state to its activation state involves holding joystick 280 toward its right-side boundary 281 for a predetermined period of time after the corresponding actuators 58 have been fully extended. In other embodiments, the position and/or orientation of the attachment member 55, and/or the load on actuators 58, causes or contributes to the activation state. These examples are illustrative of different ways to alter an operator interface from a default state to an activation state, as in step 610.

Step 612 includes communicating an activation signal to an electronic control. This activation signal is triggered by the system being altered to the activation state, for example by a push button being pressed. In other words, step 612 is automatically triggered by step 610, in this embodiment. The signal is transmitted from the operator interface to the electronic control via electrical connection 74, in the illustrative embodiments of FIGS. 1, 2 and 3. In other embodiments, the activation signal is transmitted via a wireless transmission or other alternative signal transmission means.

Step 614 includes communicating an automated vibration command from the electronic control to a power system, operably connected to an actuator. The electronic control automatically generates this vibration command in response to receiving the activation signal. In other words, step 614 is automatically triggered by step 612, in this embodiment. Whereas the activation signal is a state signal equivalent to a single bit of information in this illustrative embodiment, the automated vibration command contains all information necessary to cause the attachment actuators to vibrate. This represents a substantial advantage over prior art systems, in which the attachment actuators typically could only be caused to vibrate by the operator directly generating a signal to vibrate by manually jostling an operator interface such as a joystick or pedal. The automated vibration command of step 614 is transmitted over electronic connections, of which electronic connections 70 of FIGS. 1, 2 and 3 are illustrative, by which the electronic control relays all activating commands to the power system.

Step 616 includes causing an attachment member, tiltably mounted on a mechanical arm about a pivot joint and operably connected to the actuators controlled by the automatic vibration command, to vibrate automatically in response to the automated vibration command. One example of this would be to cause an automatic shake-out vibration of a bucket attachment. In a hydraulically powered example as in FIGS. 1 and 2, this is accomplished by pressurized hydraulic flow appropriately transmitted by the hydraulic power system, along the hydraulic lines, to the actuators. For example, hydraulic flow is rapidly alternated between opposing lines of hydraulic lines 68, in one embodiment. Rapid alternation of hydraulic pressure occurs in an alternative embodiment. In yet another embodiment, an electrical power system drives the rapid alternation of the spin direction of an electric motor pinion engaged with a rack face of a piston, following the embodiment of FIG. 3.

In these embodiments, the power system reacts directly to commands from the electronic control, so that the electronic control fulfills the function of intelligent translation of the simple activation signal into the more complicated automated vibration command, leaving the actuators to react simply to that command in causing the actuators to vibrate. The vibration of the actuators results in a corresponding vibration of the attachment member to which they are coupled and any attachment mounted on the attachment member, such as a bucket, for example. Therefore, step 616 can include a shake-out of an attached bucket, for example.

Additional steps may occur in alternative embodiments. For example, one embodiment of the method includes the further steps of altering the operator interface out of the activation state, and thereby responsively causing the attachment member to stop vibrating. Referring in part to reference numerals from the earlier figures, this may take place by moving the joystick away from its rightward limit of motion 281, for example, to either its default position or its leftward limit of motion 283, for example. Or, altering the user interface out of the activation state may be accomplished by pressing another push button enabled for that purpose, for example. The change in state of user interface 238 out of the activation state causes the electronic control 72 to stop communicating the automatic vibration command to power system 28 or 328, and thereby to stop the automatic vibration of actuators 58 or 358 and attachment member 55, in these illustrative embodiment.

An automatic vibration of attachment member 55 is performed with specific vibration parameters such as a certain frequency and amplitude of vibration. These vibration parameters are optimized for different vibration objectives, such as shake-out of attachment member 55. This may be an important performance objective to shake debris and clinging matter out of bucket 56, for example, in one illustrative embodiment. For example, one embodiment of the method may include a vibration frequency of five hertz and a vibration amplitude of one millimeter. Other embodiments include values of frequency and amplitude that are higher and lower than these values, consistent with the performance capabilities of the systems in which they are incorporated. Still other embodiments allow for frequency and amplitude to be selected from a number of different options by the operator, to be specifically optimized for a given task.

The present invention includes unexpected and novel advantages as detailed herein and as can be further appreciated from the claims, figures, and description by those skilled in the art. Although particular embodiments are described, various other embodiments of the present invention are contemplated with application to other machines, devices, methods and systems lying within the metes and bounds of the claims. Particular embodiments described above are merely representative and illustrative of the claimed invention, which is not limited to those particular embodiments.

For example, while a skid-steer loader has been particularly described, the invention is equally applicable to other types of loaders, such as all-wheel-steer loaders and tracked loaders, along with a wide variety of other power machines, such as bulldozers, bulldozer-backhoes, shovel/excavators, and a wide variety of other applications.

As another example, while the specific examples of a push button, a joystick, a pedal, and a toggle switch have been used to illustrate the operator interface, a wide variety of additional operator interfaces are contemplated and covered by the claims, such as a lever, a dial, a mouse, a touchpad, a touchscreen, a remote control, or other mechanisms, for example.

As yet another example, while the example of a construction/industrial bucket is used as a specific example of an additional attachment subject to automatic vibration, a wide variety of other attachments are also contemplated in alternate embodiments, including dirt buckets, combination buckets, planers, backhoes, dozer blades, or the attachment plate by itself, or other types of attachments.

As still another example, hydraulic and electrical systems have been described as specific examples, which are representative of other embodiments which use any other system for distributing power from a power source to the actuators.

Other features and properties of the automated hydraulic vibration control system also have a variety of embodiments encompassed by the claims, of which the particularly described examples are meant as illustrative only and not by way of limitation. Those persons who are competent in the field will recognize many changes that may be made in form and detail without departing from the spirit and scope of the invention.

The invention claimed is:

1. A system comprising:

a mechanical arm;

an attachment member tiltably mounted on the mechanical arm about a pivot joint, wherein the attachment member has a range of tilt about the pivot joint bounded by an extreme forward orientation and an extreme rearward orientation;

an actuator operably connected to the attachment member for powering the attachment member to tilt about the pivot joint;

a power system operably connected to the actuator;

an electronic control operatively connected to the power system, and comprising an automatic vibration mechanism for causing the attachment member to vibrate automatically in response to an activation signal; and an operator interface in operable communication with the electronic control;

wherein the system comprises a default state, and an activation state for causing the activation signal;

wherein the system has a predetermined segment of the range of tilt of the attachment member that is comprised in the activation state, and a remainder of the range of tilt comprised in the default state, wherein the attachment member being selectably oriented within the predetermined segment of the range of tilt comprised in the activation state is a necessary condition for causing the activation signal; and wherein the system also has a predetermined length of time, comprised in the activation state, for the attachment member to be oriented within the predetermined segment of the range of tilt, wherein the attachment member being oriented within the predetermined segment of the range of tilt for the predetermined lenath of time is a further necessary condition for causing the activation signal.

2. The system of claim 1, wherein the predetermined segment of the range of tilt includes the extreme forward orientation.

3. The system of claim 1, wherein the attachment member has a range of lift above a projected ground surface bounded by a minimum lift and a maximum lift, and wherein the system also has a predetermined segment of the range of lift of the attachment member that is comprised in the activation state, wherein the attachment member being positioned within the predetermined segment of the range of lift is a further necessary condition for causing the activation signal.

4. The system of claim 3, wherein the system also has a predetermined length of time, comprised in the activation state, for the attachment member to be positioned within the predetermined segment of the range of lift, wherein the attachment member being positioned within the predetermined segment of the range of lift for the predetermined length of time is a further necessary condition for causing the activation signal.

5. The system of claim 3, wherein the predetermined segment of the range of lift includes the maximum lift.

6. The system of claim 1, wherein the activation state comprises the attachment member undergoing a minimum load, and wherein the attachment member undergoing the minimum load is a further necessary condition for causing the activation signal.

7. The system of claim 1, wherein the activation state comprises the attachment member undergoing a minimum load, and wherein the minimum load for the activation state is detected by a mechanical strain gauge.

8. The system of claim 1, wherein the activation state comprises the attachment member undergoing a minimum load, and wherein the activation state also comprises a position and an orientation of the attachment member that are consistent with digging.

9. The system of claim 1, wherein the activation state comprises the attachment member undergoing a minimum load, and wherein the activation state also comprises a position and an orientation of the attachment member that are consistent with packing.

10. The system of claim 1, further comprising a backhoe mounted on the attachment member.

11. The system of claim 1, further comprising a bucket mounted on the attachment member.

12. The system of claim 1, wherein the actuator is hydraulically powered, and the power system provides hydraulic power.

13. The system of claim 1, wherein the actuator is electrically powered, and the power system provides electrical power.

14. The system of claim 1, further comprising a frame supported by a plurality of ground engaging wheels, wherein the mechanical arm is operably coupled to the frame.

15. The system of claim 1, further comprising a frame supported by a plurality of ground engaging tracks, wherein the mechanical arm is operably coupled to the frame.

16. A system comprising:

a mechanical arm;

an attachment member tiltably mounted on the mechanical arm about a pivot joint;

an actuator operably connected to the attachment member for powering the attachment member to tilt about the pivot joint;

a power system operably connected to the actuator;

an electronic control operatively connected to the power system, and comprising an automatic vibration mechanism for causing the attachment member to vibrate automatically in response to an activation signal; and an operator interface in operable communication with the electronic control;

wherein the system comprises a default state, and an activation state for causing the activation signal;

wherein the attachment member has a range of lift above a projected ground surface bounded by a minimum lift and a maximum lift, and a range of tilt about the pivot joint bounded by an extreme forward orientation and an extreme rearward orientation, and wherein the activation state comprises the attachment member being both positioned within a predetermined segment of the range of lift, and oriented within a predetermined segment of the range of tilt; and wherein the activation state also comprises the attachment member being positioned within the predetermined segment of the range of lift and oriented within the predetermined segment of the ranae of tilt, for a predetermined length of time.

17. The system of claim 16, wherein the operator interface comprises a push button, and the activation state comprises the push button being in a depressed position.

18. The system of claim 17, wherein the push button is disposed on a joystick.

19. The system of claim 16, wherein the operator interface comprises a joystick, and the activation state comprises the joystick being oriented in a predetermined orientation for a predetermined amount of time.

20. The system of claim 16, wherein the operator interface comprises a joystick, and the activation state comprises the joystick being jiggled.

21. The system of claim 16, wherein the actuator comprises a cylinder, and a piston slidably engaged within the cylinder.

22. The system of claim 16, wherein the operator interface comprises a console mounted on a frame to which the mechanical arm is coupled.

23. The system of claim 16, wherein the operator interface comprises a remote control console.

* * * * *